US005426497A

United States Patent [19]

Morganti et al.

[11] Patent Number: 5,426,497

[45] Date of Patent: Jun. 20, 1995

[54] ROLLER PAIR ASSEMBLY USABLE IN IMAGE FORMING APPARATUS

[75] Inventors: Terry N. Morganti, Brockport; Daniel R. Palmer, Rochester, both of N.Y.

[73] Assignee: Eastman Kodak Company, Rochester, N.Y.

[21] Appl. No.: 245,342

[22] Filed: May 18, 1994

[51] Int. Cl.[6] ..... G03G 15/00

[52] U.S. Cl. ..... 355/317; 271/242; 271/274; 355/308; 355/321

[58] Field of Search ..... 355/317, 308, 309, 321, 355/290, 295, 277; 271/242, 273, 274

[56] References Cited

U.S. PATENT DOCUMENTS

| | | | |
|---|---|---|---|
| 4,681,422 | 7/1987 | Oba et al. | 355/309 |
| 4,717,937 | 1/1988 | Fukunaga | 355/295 |
| 4,821,066 | 4/1989 | Foote, Jr. et al. | 355/317 X |
| 4,894,687 | 1/1990 | Beaudet | 355/277 |
| 4,908,633 | 3/1990 | Ohashi et al. | 355/295 X |
| 5,034,781 | 7/1991 | Watanabe | 355/317 |
| 5,227,843 | 7/1993 | Yamamoto et al. | 355/317 X |
| 5,237,381 | 8/1993 | Hamada | 355/321 |
| 5,268,726 | 12/1993 | Oleksa et al. | 355/290 |

*Primary Examiner*—Matthew S. Smith
*Attorney, Agent, or Firm*—Leonard W. Treash

[57] ABSTRACT

A roller pair assembly for a pair of registration rollers which accelerates a sheet along an image receiving path. A compression spring positioned between a clip and a retainer provides a force at each end of the rollers urging them together. The retainer includes a nest for receiving the compression spring and a bearing surface for engaging a bearing housing for one of the rollers. The clip includes a projection for engaging the compression spring and a pair of resilient arms with detents engaging detents in an outside surface of a housing for the other roller.

4 Claims, 2 Drawing Sheets

ROLLER PAIR ASSEMBLY USABLE IN IMAGE FORMING APPARATUS

This invention relates to a pressure applying structure for a pair of rollers particularly usable as the registration rollers for a sheet on which an image is to be formed.

Copiers and printers, for example, apparatus using electrophotographic, inkjet, thermal or other technologies for forming images on sheets, require proper orientation of a sheet when it is receiving the image. U.S. Pat. No. 4,821,066 to Foote et al, issued Apr. 11, 1989, shows an image forming apparatus in which a sheet is periodically fed to a transfer station to receive an image. The sheet is fed from a supply of sheets to a pair of stopped registration rollers. The nip of the registration rollers removes some of any skew in the sheet and holds it until a timing signal is received. Upon receipt of the timing signal, the rollers are rapidly accelerated, accelerating the sheet toward the transfer station with appropriate timing to receive an image properly registered on the sheet. Accurate timing of the signal to the registration rollers and accurate acceleration of the rollers provides good "intrack" registration of the sheet while the rollers themselves remove some of any skew in the sheet.

It is important that the rollers be urged together with an appropriate amount of force and that that force be relatively evenly distributed across the rollers. Among other problems that may occur from less than even distribution of this loading force, is a tendency for the rollers themselves to add some skew to the sheet as they accelerate the sheet along its path. Any skew in the sheet shows up as a skew in the ultimate image placement on the sheet and is quite noticeable as a defect.

An inexpensive approach presently in use is to apply a force to the bearing housings at each end of the rollers using a W-shaped metal clip. The W-shaped clip has detents at the ends of its outside arms which are retained by appropriate detents in outwardly facing walls on a roller housing. A lower roller bearing housing is nested in the roller housing. The joining section of the W clip has an arcuate portion which engages the bearing housing for the other roller with the overall resilience of the clip maintaining the force urging the rollers together. A clip is positioned at each end of the roller pair. While this W clip is quite inexpensive and easy to assemble, the force it applies is variable and difficult to adjust.

SUMMARY OF THE INVENTION

It is an object of the invention to provide a roller pair assembly for use as the registration rollers in an image forming apparatus, which assembly has a structure for applying a force urging the rollers together with a force that is less variable than prior structures but which structure is simple and inexpensive.

This and other objects are accomplished by a roller pair assembly which includes first and second rollers and a roller housing for holding the first roller. The housing has housing detents on opposite walls facing away from the first roller. The second roller is journaled in a second roller bearing housing. A force for urging the rollers together is supplied by a compression spring which is positioned between a U-shaped clip and a retainer. The retainer has a bearing surface for engaging the second roller bearing housing and a compression spring nest opposite the bearing surface. It also has a pair of slots. The U-shaped clip has a joining section and a pair of resilient arms which fit in the retainer slots.

Each of the arms has a clip detent for engaging one of the housing detents. The joining section has a projection for receiving the compression spring to hold it firmly in the compression spring nest in the retainer with the compression spring providing the force urging the rollers together.

This structure combines the advantages of the reliable, easily controlled force of the compression spring with the ease of mounting using the resilient arms and detents of the clip.

According to a preferred embodiment, the bearing surface of the retainer is arcuately shaped to fit a cylindrical bearing housing and the retainer has retaining ears on opposite sides of the bearing surface for engaging opposite sides of the bearing housing to hold the retainer and the clip fixed with respect to movement parallel to the axis of rotation of the rollers.

DETAILED DESCRIPTION OF THE INVENTION

Figure 1:
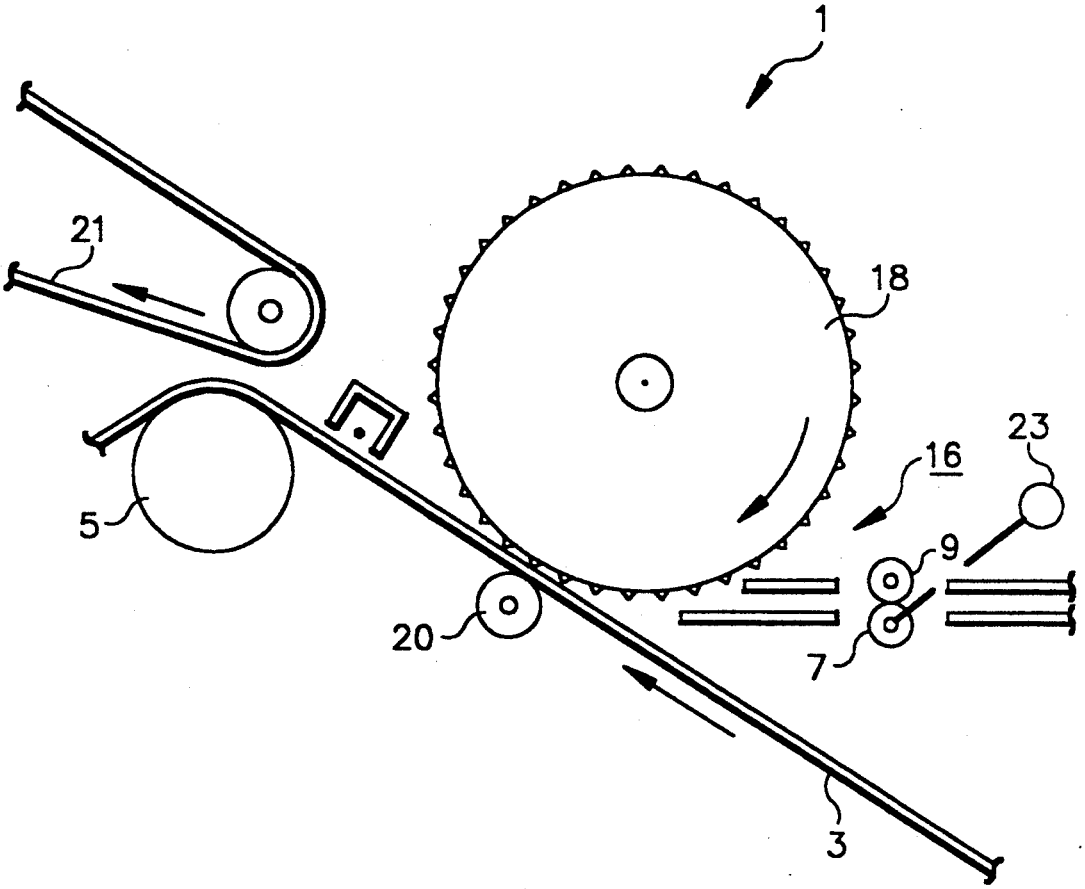
FIG. 1 is a side schematic of a portion of an image forming apparatus.

The invention is usable in any type of image forming apparatus. According to FIG. 1, image forming apparatus 1 is electrophotographic. However, it also could be an inkjet printer or other similar apparatus.

An image member 3 is trained about a series of rollers, including a roller 5 for movement through an endless path during which a series of toner images are formed on image member 3. The toner images are transferred to a receiving sheet at a transfer station which includes a transfer drum 18 and a backing roller 20. The receiving sheet is fed from a receiving sheet supply (not shown) to a pair of registration rollers 7 and 9. When the sheets arrive at the registration rollers 7 and 9, they are stopped. The logic and control of the apparatus provides an appropriate signal to a motor 23 which accelerates the rollers to accelerate the sheet toward a nip 16 between the transfer roller 18 and the image member 3. After transfer of a toner image to the receiving sheet, the sheet is separated from image member 3 at roller 5 and transported on to a fuser (not shown) by a sheet transport 21.

The proper acceleration and timing of the drive of registration rollers 7 and 9 provides accurate intrack registration between the receiving sheet and the image. The nip of registration rollers 7 and 9 also has a tendency to reduce any skew in the sheet when it arrives. To avoid the addition of skew during the sheet acceleration function, it is important that the rollers have even "linear" pressure the length of the nip. This is provided by a roller pair assembly 17 shown in FIGS. 2 and 3.

Figure 2:
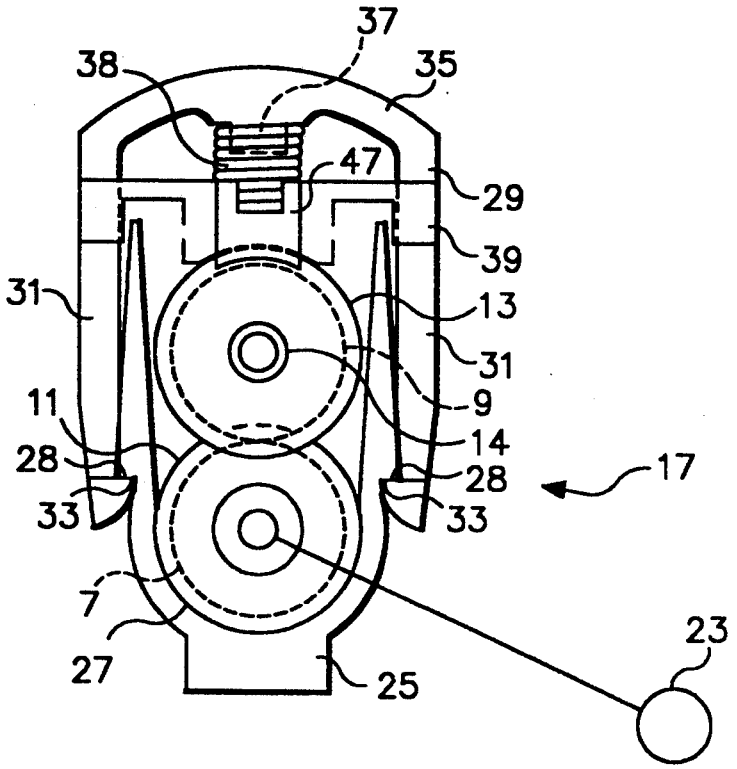
FIG. 2 is a side view of a roller pair assembly with some portions in phantom.

According to FIG. 2, roller pair assembly 17 includes first or lower roller 7 and second or upper roller 9, both shown in phantom. Upper roller 9 includes a shaft 14 and a bearing housing 13 at each of its ends. Lower roller 7 includes a bearing housing 11 at one end, while the other end is connected to motor 23 and may not have a bearing housing. A roller housing 25 includes a nest 27 for receiving the lower roller 7. As shown in FIG. 2, lower roller bearing housing 11 fits in nest 27. Nest 27 could alteratively support a portion of the housing for the motor 23. Housing 25 also has a pair of housing detents 28 in outer walls facing away from lower roller 7.

A force urging the rollers together is supplied by a compression spring 38 which is held between a U-shaped or horseshoe-shaped clip 29 and a retainer 39.

Figure 3:
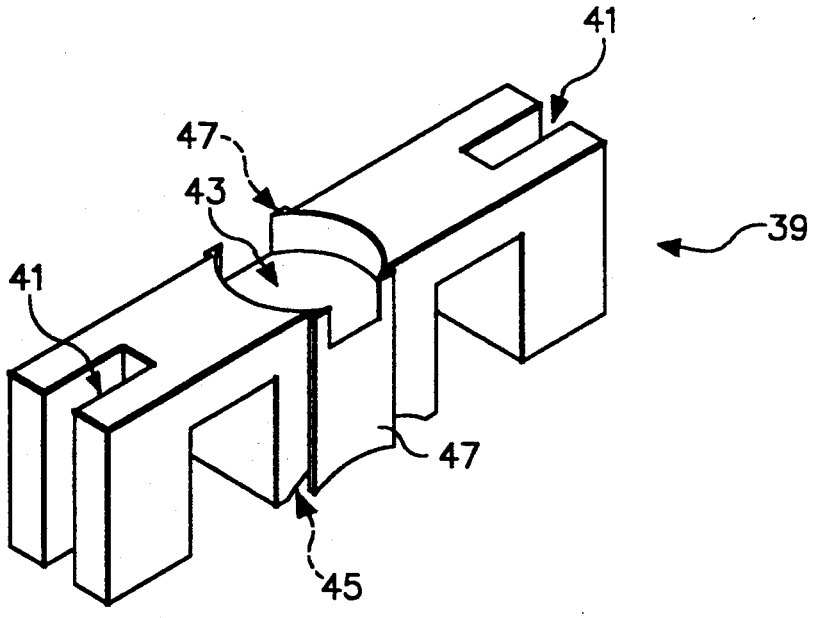
FIG. 3 is a perspective view of a retainer.

The retainer 39 is best seen in FIG. 3. It includes an arcuate bearing surface 45 which rests on the upper roller bearing housing 13 and a compression spring nest 43 opposite the bearing surface 45. A pair of slots 41 are formed in ends of retainer 39. A pair of ears 47 extend below arcuate bearing surface 45. The retainer rests on the top of bearing housing 13 with ears 47 extending below the top of the housing to maintain the axial location of the retainer.

The clip 29 has a joining section 35 connecting two resilient arms 31, which arms fit in slots 41 in retainer 39. The arms 31 have clip detents 33 which engage the housing detents 28 on housing 25 to hold the clip in place. A tooth or projection 37 extends from the joining section 35 into compression spring 38 while the joining section urges the compression spring toward the retainer 39. Thus, the nest 43 and the projection 37 hold the compression spring in place. The compression spring then urges the retainer and the clip apart which applies a force urging the rollers 7 and 9 together.

This structure provides an accurate force at each end of the rollers urging them together. This structure is free from occasional excess in the force that occurred with prior W-shaped clips, but still maintains the simplicity and ease of assembly afforded by the detent structures in the clip arms. With applicants' structure, compression springs having rates as low as 17–18 pounds per inch are effective, while the prior W-shaped clips often had a spring rate as high as 180 pounds per inch. Thus, manufacturing tolerances become less critical and constant linear pressure across the nip is easier to maintain. In the specific application it was designed for, it is usable without a change in the housing 25 or in the bearing housings 11 and 13.

The invention has been described in detail with particular reference to a preferred embodiment thereof, but it will be understood that variations and modifications can be effected within the spirit and scope of the invention as described hereinabove and as defined in the appended claims.

We claim:

1. For use in an apparatus in which an image is formed on a sheet which sheet is fed through an image receiving path, a roller pair assembly for receiving the sheet and feeding it along said path, said roller pair assembly comprising:

first and second rollers, a roller housing for holding a first roller bearing housing of said first roller, said roller housing having housing detents on opposite walls facing away from the first roller, a second roller bearing housing; in which said second roller is journaled, a compression spring, a retainer having a bearing surface, for engaging the second roller bearing housing, a compression spring nest opposite the bearing surface for receiving; the compression spring, and a pair of slots, a U-shaped clip having a joining section and a pair of resilient arms extending from the joining section and positioned in the slots, each of the arms having a clip detent for engaging one of the housing: detents, and the joining section having a projection for receiving the compression spring to hold it firmly in the compression spring nest, with the spring urging the clip and retainer apart thereby urging the rollers together.

2. A roller pair assembly according to claim 1 wherein said retainer further includes a pair of ears on either side of the bearing surface extending beyond the bearing surface to limit the movement of the retainer axially with respect to the second roller bearing housing.

3. A roller pair assembly according to claim 1 wherein the bearing surface of the retainer is arcuate to fit a cylindrical second roller bearing housing.

4. A roller pair assembly comprising:

first and second rollers, a roller housing for holding a first roller bearing housing of said first roller, said roller housing having housing detents on opposite walls facing away from the first roller, a second roller bearing housing in which said second roller is journaled, a compression spring, a retainer having a bearing surface for engaging the second roller bearing housing, a compression spring nest opposite the bearing surface for receiving the compression spring, and a pair of slots, and a U-shaped clip having a joining section and a pair of resilient arms extending from the joining section, each of the arms having a clip detent for engaging the housing detents, and the joining section having a projection for engaging the compression spring with the compression spring urging the clip and retainer apart thereby urging the rollers together.

* * * * *